US005078196A

United States Patent [19]

Rozon

[11] Patent Number: 5,078,196

[45] Date of Patent: Jan. 7, 1992

[54] VERTICAL BLINDS LINK

[76] Inventor: David P. Rozon, P.O. Box 635, Russell, Ontario, Canada, K0A 3B0

[21] Appl. No.: 493,386

[22] Filed: Mar. 14, 1990

[30] Foreign Application Priority Data

Mar. 16, 1989 [CA] Canada ..... 593957

[51] Int. Cl.[5] ..... E06B 9/30

[52] U.S. Cl. ..... 160/178.1; 160/900

[58] Field of Search ..... 160/178.1, 900, 173, 160/168.1, 349.2, 199; 248/288.3; 24/453, 573.1, 573.5

[56] References Cited

U.S. PATENT DOCUMENTS

| | | | |
|---|---|---|---|
| 2,717,035 | 9/1955 | Groth . | |
| 2,759,534 | 8/1953 | Harju . | |
| 2,822,043 | 2/1958 | Horak . | |
| 3,106,240 | 10/1963 | Weber | 160/900 X |
| 3,365,684 | 1/1968 | Stemke et al. | 160/349.2 X |
| 4,197,616 | 4/1980 | Panuski | 160/349.2 |
| 4,294,345 | 10/1981 | Stauber et al. | 198/683 |
| 4,529,025 | 7/1985 | Oskam | 160/178.1 |
| 4,696,336 | 9/1987 | Dixon . | |
| 4,887,659 | 12/1989 | West | 160/199 |

FOREIGN PATENT DOCUMENTS

| | | | |
|---|---|---|---|
| 963799 | 3/1975 | Canada | 160/21 |
| 1260837 | 4/1961 | France | 248/288.3 |

*Primary Examiner*—Blair M. Johnson

*Attorney, Agent, or Firm*—Dressler, Goldsmith, Shore, Sutker & Milnamow, Ltd.

[57] ABSTRACT

An arrangement of links is provided to connect the free ends of the vanes of a vertical blind. The links are comprised of a cleat portion adapted to engage a vertical blind and an articulated arm linking two cleats attached to neighboring vanes.

5 Claims, 4 Drawing Sheets

VERTICAL BLINDS LINK

BACKGROUND OF THE INVENTION

The present invention is a link for use in vertical window blinds, to connect the free lower end portions of the vanes of such blinds. Such a link is used to prevent the free ends of the vanes from tangling and flapping, for example where such a blind hangs in front of an open window. A link for such an application must be capable of allowing the blind to open and close freely, and thus must allow both horizontal displacement and rotational movement of the vanes. At the same time, the link must be sufficiently rigid to limit unwanted movement of the vanes.

A variety of means are known to connect the free ends of the vanes of a vertical window blind to each other. U.S. Pat. No. 4,696,336 discloses an arrangement of chains that links the lower end portions of a set of vanes, and U.S. Pat. No. 2,717,035 discloses an articulated strip that runs the length of a set of vanes, each segment of which is rotatably attached to the lower end of a vane. Other similar examples are known to the art. Such devices suffer several disadvantages. They are in general complex both to manufacture and to install into an already assembled blind, the latter being a frequent requirement in "custom" applications. Rigid links known to the art tend to be heavy, highly visible and unsightly, while chain link devices fail to provide a secure link, become entangled, and are difficult to assemble so as to maintain proper spacing between the vanes.

Accordingly it is an object of the present invention to provide an improved link to secure the lower margins of a vertical blind.

BRIEF DESCRIPTION OF THE INVENTION

The present invention is an arrangement of links adapted to connect the vanes of a vertical blind. Each of the links is comprised of an articulated arm pivotally engaged to a cleat at each end thereof. The cleat is adapted to engage a vane and a second, opposing cleat, by engagement means to fixedly engage both a first face of a vane and a second like cleat engaged to a second face of the vane.

DESCRIPTION OF THE PREFERRED EMBODIMENTS

Figure 1:
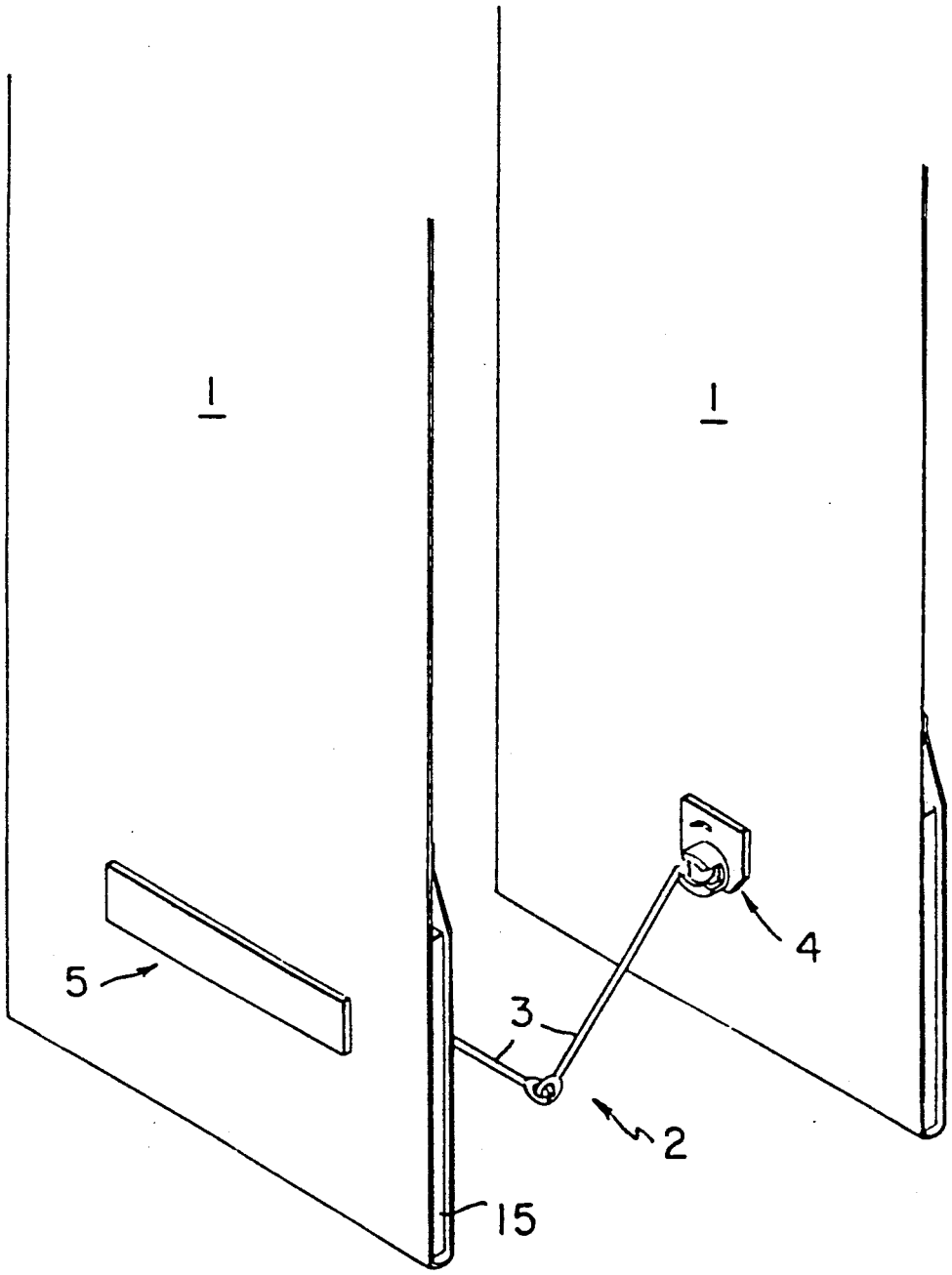
FIG. 1 is a perspective view of a portion of a set of vertical blinds, illustrating the free ends of two vertical blind vanes, connected by a set of links according to the present invention.

Referring to FIG. 1, the lower free ends of vanes 1 of a vertical blind are illustrated, connected by an arrangement of links 2. Vanes 1 are flat or nearly flat and are made of stiffened fabric, plastic or other reasonably rigid material. The arrangement of links consists of a series of interlocking elements, comprised of articulated arms having two identical limbs 3, cleats 4 connecting the arms to the vanes and a decorative end cap 5 at each end of the arrangement. Each limb 3 is engaged at a first end to a cleat 4 and at a second end to a second limb 3. At both such engagement points, the limb 3 is capable of pivotal movement both horizontally and vertically relative to its engaged member.

The vane 1 is provided with a metal weight 15, supported within the folded-over lower margin of the vane 1. The weight 15 has an aperture 16 in the middle thereof, suitably positioned to allow two opposing cleats 4 to attach to each other through the aperture. It will be seen that when two opposing cleats 4 are connected to each other, they help keep the weight 15 in position.

Figure 3:
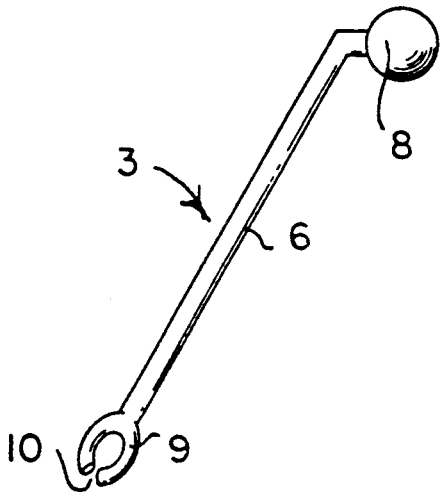
FIG. 3 is a side elevational view of an arm portion of a link.
Figure 4:
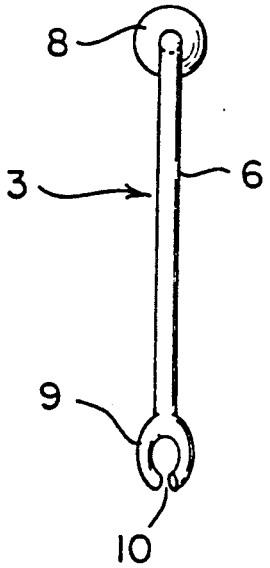
FIG. 4 is an front elevational view of an arm portion of a link.

Referring to FIGS. 3 and 4 the limb 3 is illustrated in greater detail. Each limb 3 is comprised of an elongate cylindrical member 6, which has a bend of approximately 60° adjacent a first end thereof. The first end is provided with a ball 8 at the end thereof. The second end of the limb is provided with a ring 9, comprised of a flat C-shaped element, the plane of which is angled at approximately 45° from the plane formed by the bend of the cylindrical member 6. The ring 9 has a tapered slot 10 at the free end thereof, that communicates with the inside of the ring. The taper of the slot 10 widens towards the outside of the ring. The slot 10 is adapted to allow an opposing ring 9 to be snap-fitted thereto.

Figure 5:
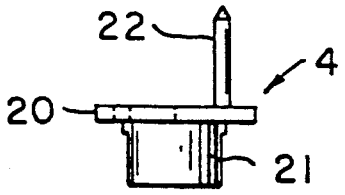
FIG. 5 is a top view of a cleat portion of a link.
Figure 6:
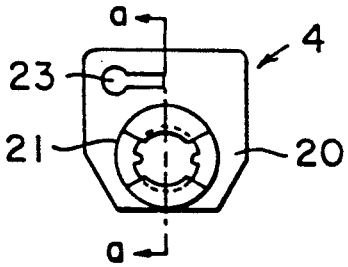
FIG. 6 is a front view of a cleat portion.

Referring to FIGS. 5 and 6, each cleat 4 is comprised of a plate 20 having an inside face adapted to be positioned against the face of a vane, a socket 21 extending outwardly from an outside face of the plate 20, and a spike 22 extending outwardly from the inside face thereof. The plate 20 has a keyhole-shaped slot 23 adjacent the spike 22, adapted to receive a spike 22 from an opposing cleat 4. The keyhole shape allows the hole to expand sufficiently to snap-fit the spike 22.

Figure 2:
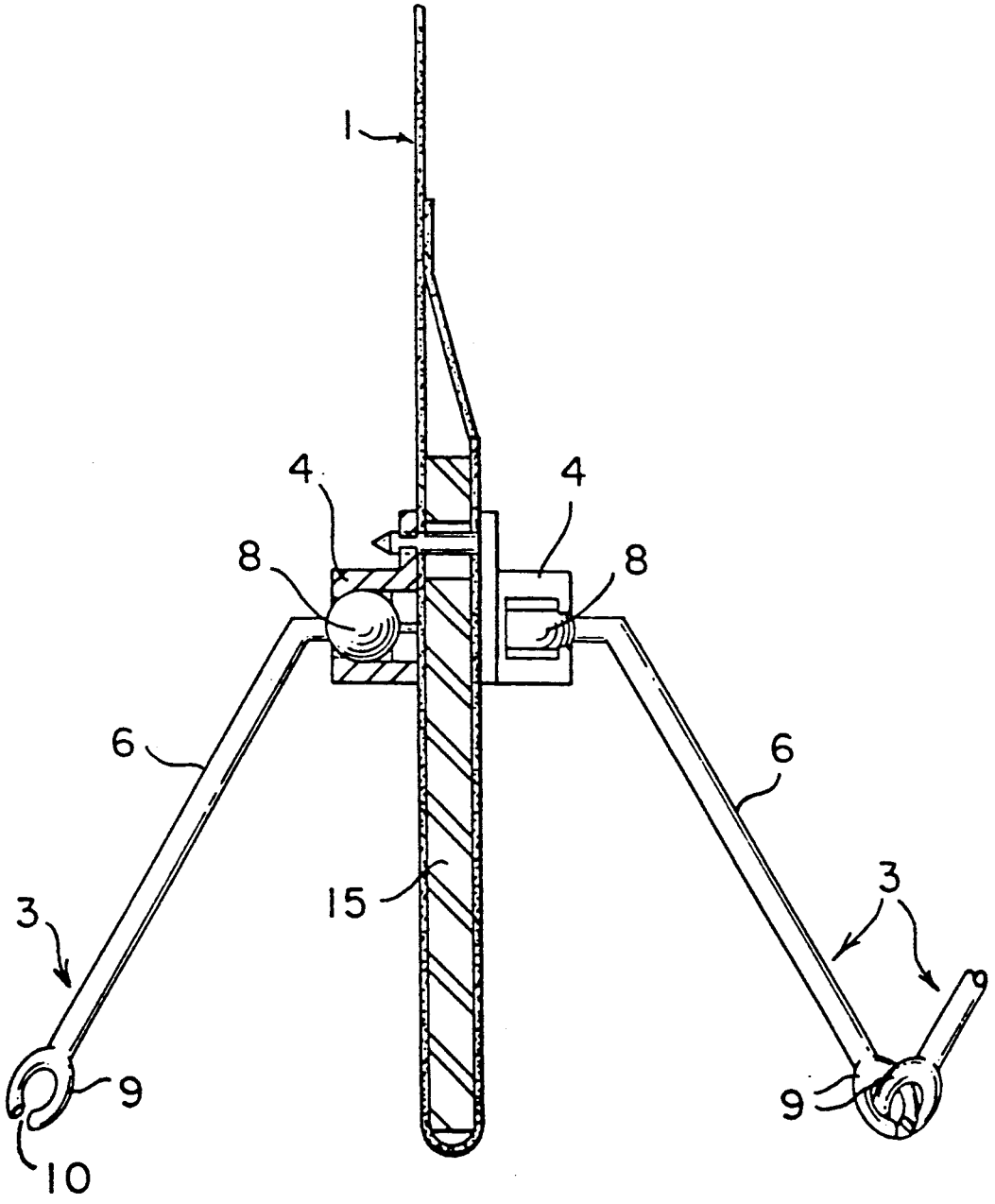
FIG. 2 is an elevational view, partly in cross-section, illustrating portions of two links positioned on a vane.
Figure 8:
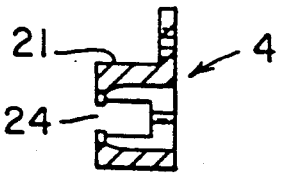
FIG. 8 is a sectional view of a cleat portion taken along line a—a of FIG. 6.

Referring to FIG. 8, the socket 21 is similarly provided with a channel 24 on either side thereof, to allow the ball 8 to be snap-fitted therein as illustrated in FIG. 2.

Figure 9B:
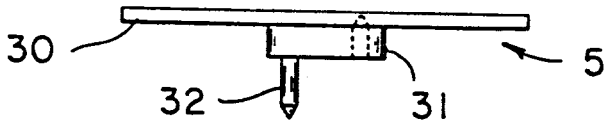
FIGS. 9(*a*) and 9(*b*) are front and top views, respectively of an end cap portion of an arrangement of links.
Figure 9A:
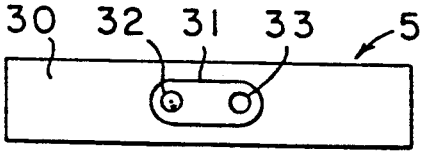

Referring to FIGS. 9(*a*) and 9(*b*), the end cap 5 is comprised of a plate 30 and a mount 31. The mount 31 is provided with a spike 32 and a recess 33, adapted to engage an opposing spike of a cleat 4.

Figure 7:
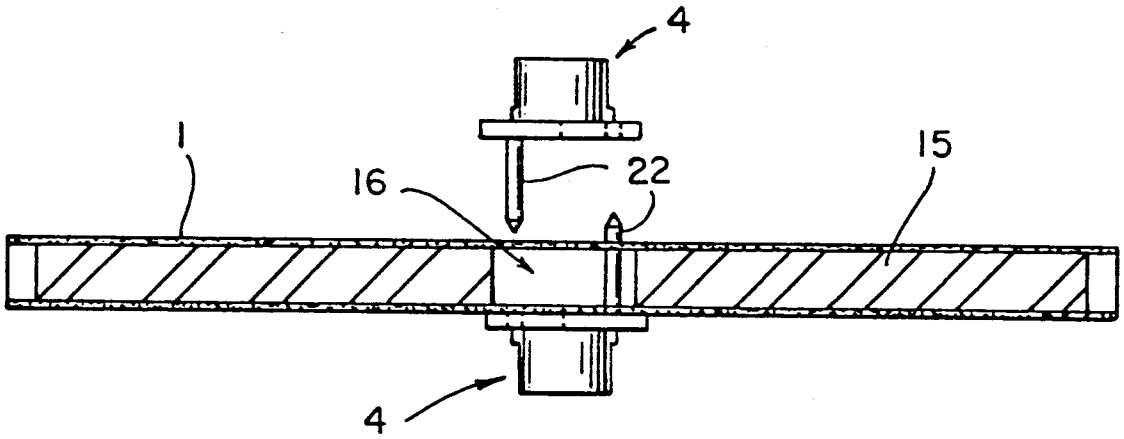
FIG. 7 is a top view, partly in cross section, of two corresponding cleat portions, one of which is positioned on the vane of a vertical blind.

In use, a series of links may be assembled to link any number of vanes. The end cap 5 is engaged to the first vane in the series by pressing the spike 32 through the fabric or plastic material of the vane. The end cap 5 must be engaged to a portion of the vane facing the aperture 16. A cleat 4 is engaged to the second face of the vane, opposite the end cap 5, by snap-fitting the spike 22 of the cleat 5 within the recess 33 of the end cap. In like manner, as illustrated in FIG. 7, pairs of cleats 4 are snap-fitted together on opposing faces of the remaining vanes, on either side of the aperture 16. As illustrated in FIG. 2, a limb 3 is then engaged to each pair of cleats 4, by snap-fitting the ball 8 of each limb 3 into the socket 12 of the cleat 4. The free end of each limb is engaged to a second free limb by snap-fitting the rings 9 of each limb together.

It will be seen that the elements making up the arrangement of links requires them to be made of a resilient material such as polycarbonate. It is also desirable that the tolerances of all elements are reasonably close, both to prevent chatter and vibration when the vanes are disturbed, and to ensure that the links are sufficiently stiff to damp any wave-like motion that may otherwise occur when the vanes are disturbed.

In use, when the blind is opened, and the vanes are consequently brought into contact with each other, the limbs 3 are forced to pivot downwards. The bend in the limb 3 allows the cylindrical member 6 to pivot vertically downwards. When the blind is in the closed position, and the vanes are at their normal spaced-apart position, the bend allows the cylindrical members 6 to angle downwards at approximately 30° from the horizontal. When the blind is closed, the relatively tight clearances of the ball and socket joint between the limb 3 and the cleat 4 prevent the limb 3 from pivoting upwards by more than an additional few degrees, and consequently prevents neighboring vanes from drifting too far apart.

It will be seen that various alterations may be made to the described embodiment without departing from the spirit and scope of the invention, as claimed in the appended claims.

What I claim as my invention is:

1. An arrangement of links adapted to connect the vanes of a vertical blind, each of said links comprised of an articulated arm pivotally engaged by means of a ball and socket joint to a cleat at each end of said arm, said cleat having vane engagement means to fixedly engage both a first face of a vane and a second cleat engaged to a second face of said vane; wherein said vane engagement means is comprised of a spike extending outwardly from said cleat and a spike-receiving means, wherein the spike of said cleat engages the spike-receiving means of said second cleat and the spike of said second cleat engages the spike-receiving means of said cleat.

2. The arrangement of links as claimed in claim 1, wherein said articulated arm is comprised of a first limb and a second limb, said first limb having articulation means at a free end distant from said cleat, said articulation means releasably and pivotally engaging a free end of the second limb.

3. The arrangement of links as claimed in claim 2, wherein said articulation means is comprised of an annular member having a slot communicating between the inside and the outside thereof, releasably engaging a corresponding annular member on the free end of said second limb.

4. The arrangement of links as claimed in claim 1, wherein said ball and socket joint releasably engages said cleat with said arm.

5. The arrangement of links as claimed in claim 1, wherein said arm has an angled portion adjacent said cleat, said angled portion cooperating with said ball and socket joint to permit said arm to articulate freely downwards, but to limit the freedom of said arm to articulate upwards beyond a predetermined position.

* * * * *